United States Patent [19]

Perez

[11] Patent Number: 4,826,399

[45] Date of Patent: May 2, 1989

[54] UNISON RING MOUNTING ARRANGEMENT

[75] Inventor: Lucas R. Perez, Indianapolis, Ind.

[73] Assignee: General Motors Corporation, Detroit, Mich.

[21] Appl. No.: 190,918

[22] Filed: May 6, 1988

[51] Int. Cl.[4] ..... F01D 17/16

[52] U.S. Cl. ..... 415/150; 415/148; 415/159

[58] Field of Search ..... 415/146, 147, 148, 149, 415/150, 151, 159, 160

[56] References Cited

U.S. PATENT DOCUMENTS

| | | | |
|---|---|---|---|
| 2,933,234 | 4/1960 | Neumann | 415/149 |
| 2,936,108 | 5/1960 | Balcom et al. | 415/149 |
| 3,074,689 | 1/1963 | Chapman | 415/147 |
| 3,089,679 | 5/1963 | Henny | 415/160 |
| 3,736,070 | 5/1973 | Moskowitz et al. | 415/160 |
| 3,841,788 | 10/1974 | Sljusarev et al. | 415/147 |
| 4,430,043 | 2/1984 | Knight et al. | 415/159 |
| 4,773,821 | 9/1988 | Gonthier et al. | 415/160 |

FOREIGN PATENT DOCUMENTS

| | | | |
|---|---|---|---|
| 1277868 | 1/1961 | France | 415/149 |
| 1533940 | 11/1978 | United Kingdom | 415/160 |

*Primary Examiner*—Robert E. Garrett
*Assistant Examiner*—John T. Kwon
*Attorney, Agent, or Firm*—Saul Schwartz

[57] ABSTRACT

A support arrangement for a unison ring in a system for varying the angles of attack of compressor vanes in an axial flow gas turbine engine compressor. The support arrangement includes a plurality of struts which provide radial support for the unison ring on the compressor case and a corresponding plurality of eccentric washers disposed between platforms on the struts and an overhanging flange on the unison ring. When the washers are rotated, the positions of the struts are adjusted radially and when the washers and struts are clamped to the unison ring, forces are reacted between the struts and the unison rings through the washers.

3 Claims, 2 Drawing Sheets

UNISON RING MOUNTING ARRANGEMENT

The invention herein described was made in the course of work under a contract or subcontract thereunder with the Department of Defense.

FIELD OF THE INVENTION

This invention relates generally to variable geometry axial flow compressors for gas turbine engines.

DESCRIPTION OF THE PRIOR ART

The efficiency of gas turbine engine compressors is improved if the angle of attack of the compressor stator vanes is matched to the air flow through the engine over a range of air flows corresponding to different engine operating conditions. To that end, typical variable geometry systems for pivoting the stator vanes about generally radial axes include unison rings for each stage of variable vanes, actuating arms attached to each vane, and a socket arrangement between the distal ends of the actuating arms and the unison rings. The unison rings are supported on the compressor case for rotation about the main axis the compressor case and are powered by one or more servomotors. To maintain concentricity of the unison ring while minimizing friction, some ring mounting systems use rollers on one of the compressor case and the unison ring rolling on a matching surface on the other. In other systems, the unison rings have sliding bearing surfaces which slide directly on matching surfaces on or connected to the compressor case. A unison ring mounting arrangement according to this invention represents an improvement in such mounting arrangements in that it incorporates particularly simple and effective adjustable connections between radial struts which slide on the compressor case and the unison ring.

SUMMARY OF THE INVENTION

This invention is a new and improved mounting arrangement for a unison ring in a variable geometry system in a gas turbine engine compressor. The mounting arrangement according to this invention includes a unison ring having a plurality of sockets for reception of bearings on the vane actuating arms, a plurality of struts adapted for sliding engagement on bearing surfaces on the compressor case, and adjustable connections between the struts and the unison ring which react loads directly between the two. For each strut, the unison ring has a bolt hole parallel to the main axis of the compressor case which opens into a corresponding radially inward extending notch in an end face of the unison ring, the end face being bounded by an overhanging flange at a radial outer extremity of the end face. The strut has a flat mounting tab at its distal end which abuts a bottom surface of the notch in the unison ring, a bolt slot through the mounting tab in register with the bolt hole in the unison ring, and a platform at the radial inner extremity of the mounting tab on the side thereof opposite the bottom surface of the notch. A connecting bolt is threaded into the unison ring bolt hole and extends through the slot in the mounting tab and through an eccentric washer interposed between the mounting tab and the head of the bolt. The cam edge of the eccentric washer engages the platform on the mounting tab and the overhanging flange on the unison ring. The inward radial reach of the strut is adjusted by rotating the washer. When the bolt is thereafter tightened, the adjustment is captured. The eccentric washer reacts loads directly between the strut and the unison ring.

DESCRIPTION OF THE PREFERRED EMBODIMENT

Figure 1:
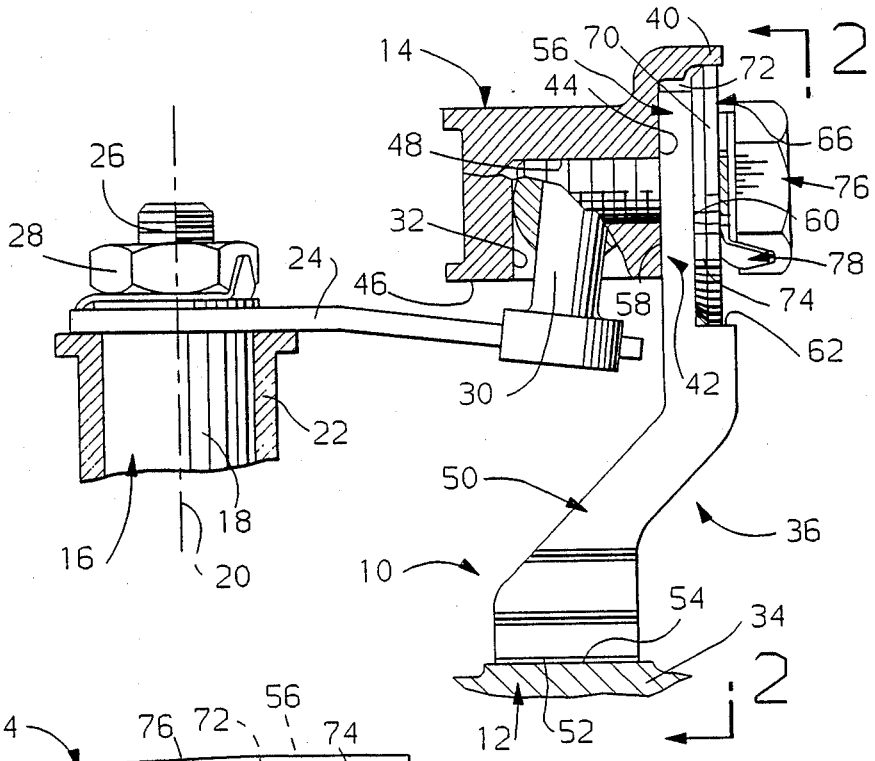
FIG. 1 is a side elevational view of a unison ring mounting arrangement according to this invention.
Figure 2:
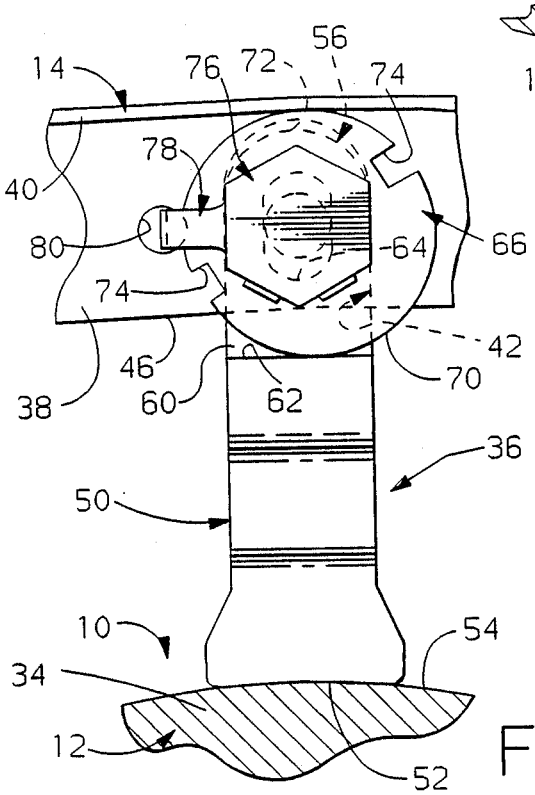
FIG. 2 is a view taken generally along the plane indicated by lines 2—2 in FIG. 1.

Referring to the drawings, a compressor section 10 of a gas turbine engine is fragmentarily illustrated in FIGS. 1 and 2. The compressor section is representative of conventional variable geometry, axial flow gas turbine compressor sections and may include a plurality of stages of movable vanes on a case 12 of the compressor section and a plurality of blade stages between the vane stages on a rotor of the compressor. As is further conventional, the compressor section has one or more unison rings around the compressor case 12 for moving all the vanes in one or more stages together. For simplicity, only a single unison ring 14 is illustrated in the drawings and only a single compressor vane 16 of the single vane stage associated with the unison ring is shown in FIG. 1.

Figure 3:
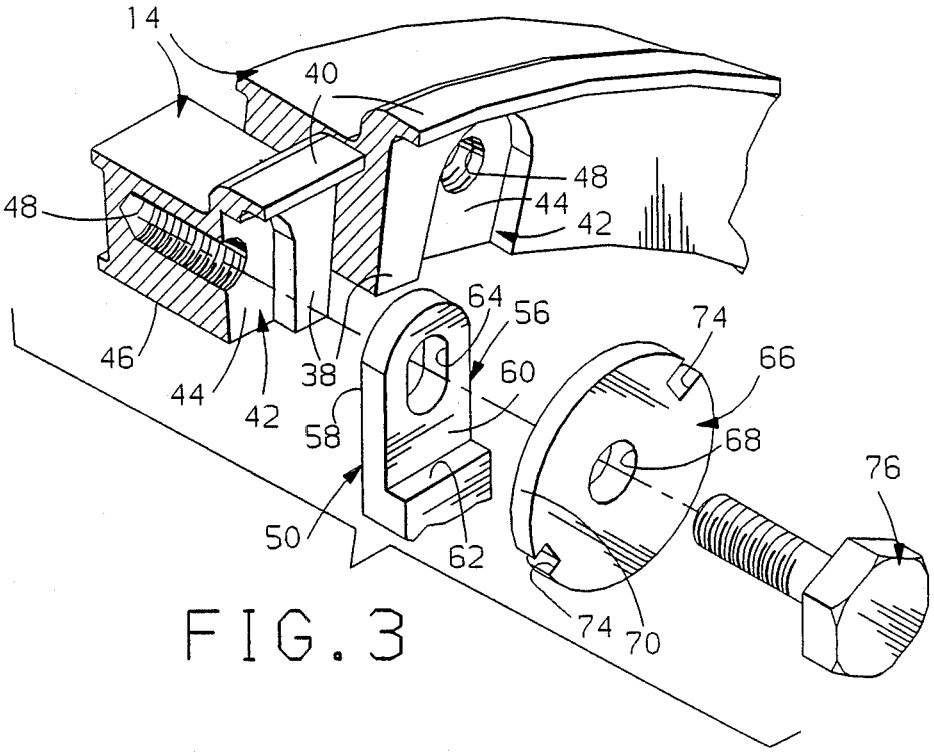
FIG. 3 is an exploded perspective view of the unison ring mounting arrangement according to this invention.

With reference to FIGS. 1,2 and 3, a stem 18 of the compressor vane 16 is aligned on a radial axis 20 of the compressor case and is supported on the latter for rotation about the axis 20 by a sleeve bearing 22. A actuating arm 24 fits over a threaded end 26 of the stem 18 and is rigidly clamped to the vane by a nut 28 on the threaded end. A ball stud 30 is affixed to the actuating arm at the end thereof opposite the vane 16. The ball portion of the stud is slidably received in a radial cylindrical socket 32 in the unison ring 14.

The compressor case 12 has an outside wall or surface 34 defining a cylinder centered about the axis of rotation, not shown, of the compressor rotor which axis is referred to herein as the main axis of the compressor case. By rotating the unison ring 14 about the main axis of the compressor case, the actuating arm rotates the vane 16 about the radial axis 20. At the same time, because of the foreshortening effect of the actuating arm 24, the unison ring also translates in the direction of the main axis toward and away from the vane 16. The unison ring is supported on the compressor case 12 for rotation about and translation in the direction of the main axis of the case by a unison ring mounting arrangement 36 according to this invention.

As part of the mounting arrangement 36, the unison ring 14 includes an end face 38 disposed in a plane perpendicular to the main axis of the compressor case. The unison ring has an annular overhanging flange 40 at the radial outer extremity of the end face 38 which flange extends beyond the plane of the end face. At regular intervals around the unison ring, the end face is interrupted by a plurality of notches 42 in the unison ring. Each notch has a planar bottom surface 44 parallel to the end face 38 and opens through a radially inner wall 46 of the unison ring. A plurality of threaded bolt holes 48, FIG. 3, in the unison ring intersect and extend perpendicular to respective ones of the notch bottom surfaces 44 of the notches 42.

The mounting arrangement 36 further includes a plurality of elongated struts 50, only one of which is shown in the drawings. The strut 50 includes a bearing surface 52 at its radial inner end adjoining a cylindrical outside bearing surface 54 on the compressor case centered on the main axis of the compressor case. At its opposite end, the strut 50 has a flat mounting tab 56 in the notch 42. The mounting tab 56 has a planar first side 58, referred to below as the ring side, abutting the bottom surface 44 of the notch, and a planar second side 60, referred to below as the washer side. A platform 62 on the washer side 60 defines a radial inner extremity of the mounting tab 56. A clearance slot 64 in the mounting tab 56 extends in the length direction of the strut 50 and registers with the threaded bolt hole 48 in the unison ring.

An eccentric flat washer 66 of the mounting arrangement 36 has a clearance hole 68 therein and a cam edge 70 therearound. The cam edge is located eccentrically relative to the center of the hole 68. The washer 66 abuts the washer side 60 of the mounting tab 56 with the hole 68 registering with the bolt hole 48 in the unison ring and with the cam edge 70 engaging both the platform 62 and the overhanging flange 40. A clearance 72, FIGS. 1 and 2, is maintained at all times between the radial outer extremity of the strut 50 and the radial outer extremity of the notch 42. The washer 66 has a pair of gripping notches 74 therein suitable for engagement by a spanner for rotating the washer.

A bolt 76 projects through the clearance hole 68 in the washer and the clearance slot 64 in the mounting tab and threads into the bolt hole 48 in the unison ring. A lock 78 between the head of the bolt and the washer 66 has a leg bent into a hole 80, FIG. 2, in the end face 38 of the unison ring to prevent the lock from rotating. The lock also has several tangs which can be bent around the head of the bolt to prevent the bolt from rotating.

With the bolt 76 loose and the lock tangs flat, the washer 66 is rotated about the shank of the bolt. The cam edge 70 varies the spacing between the overhanging flange 40 on the unison ring and the platform 62 on the strut. By sequentially rotating the washers on the several struts around the unison ring 14, the ring may be precisely centered relative to the main axis of the compressor case. At the same time, the clearances between the bearing surfaces 52 and 54 on the struts and on the compressor case are established.

The adjusted position of the unison ring is captured by tightening each of the bolts 76 to clamp the mounting tab 56 and the washer 66 against the unison ring. In that condition, the bearing surface 52 on the strut defines the inner bearing of the unison ring on the compressor case both for rotation of the ring about the main axis of the case and for translation of the ring in the direction of the main axis.

The simultaneous engagement of the edge 70 of the washer 66 on both the overhanging flange 40 and the platform 62 is an important feature of this invention. More particularly, the struts react relatively significant forces between the unison ring and the compressor case during engine operation. If the struts are only clamped against the unison ring, at least a portion of these forces might be reacted through the connecting bolts 76. In the mounting arrangement 36, however, the forces are reacted directly from the struts to the unison ring through the washers 66. That is, the forces are reacted at the interfaces between the platform 62 and the edge 70 of the washer and between the edge 70 and the overhanging flange 40.

Figure 4:
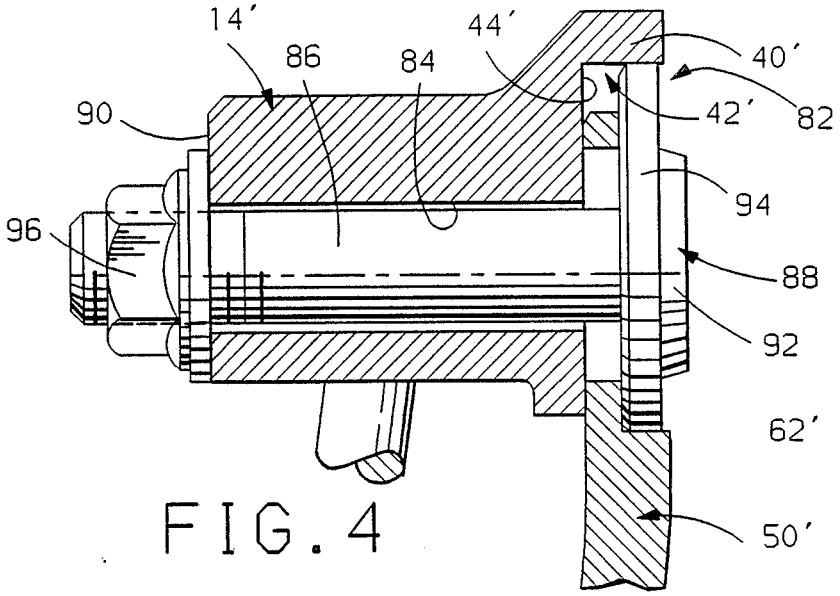
FIG. 4 is a view of a portion of FIG. 1 showing a modified embodiment of the unison ring mounting arrangement according to this invention.

Referring to FIG. 4, a modified unison ring attaching arrangement 82 according to this invention is illustrated. In the modified embodiment 82, the unison ring 14, has a through hole 84 therein perpendicular to the bottom surface 44' of the notch 42'. A threaded shank 86 of a modified connecting bolt 88 is disposed in the through hole and projects beyond a second end face 90 of the unison ring on the side thereof opposite the strut 50'. The modified connecting bolt 88 has a head 92 for gripping by a spanner and an integral eccentric washer portion 94 adjacent the head. The washer portion 94 is located between the overhanging flange 40' on the unison ring 14, and the platform 62, on the strut.

Strut adjustment in the modified embodiment is effected by rotating the connecting bolt 88. When optimum adjustment is achieved, a nut 96 is threaded onto the distal end of the connecting bolt and tightened against the second end face 90 of the unison ring. The clamping force of the nut/bolt combination captures the adjusted positions of the elements while forces are reacted between the compressor case and the unison ring through the washer portion 94 of the bolt rather than through the shank portion thereof.

The embodiments of the invention in which an exclusive property or privilege is claimed are defined as follows:

1. In a gas turbine engine having a stage of variable geometry compressor vanes on a generally cylindrical compressor case of said engine centered on a main axis of said engine and a unison ring around said compressor case for setting the angle of attack of each compressor vane in said stage, a unison ring mounting arrangement comprising:

means on said unison ring defining an end face in a plane generally perpendicular to said main axis, means on said unison ring defining an overhanging flange at a radially outer extremity of said end face extending beyond the plane thereof, a strut including a bearing surface at a radially inboard end thereof and a planar mounting tab at a radially outboard end thereof having a ring side and a washer side, means on said strut defining a platform thereon said washer side of said mounting tab, said ring side of said mounting tab being disposed against said unison ring with said bearing surface thereon adjoining a bearing surface on said compressor case and with said platform generally parallel to said overhanging flange, eccentric flat washer means abutting said washer side of said mounting tab between said platform on said strut and said overhanging flange on said unison ring and engageable on each to vary the distance between said platform and said overhanging flange when said flat washer means is rotated while abutting said washer side of said mounting tab, and clamping means on said unison ring operative to clamp said eccentric flat washer means against said mounting tab and said mounting tab against said unison ring so that the relative position of said strut is captured and said eccentric flat washer reacts loads directly between said platform and said overhanging flange.

2. In a gas turbine engine having a stage of variable geometry compressor vanes on a generally cylindrical compressor case of said engine centered on a main axis of said engine and a unison ring around said compressor case for setting the angle of attack of each compressor vane in said stage, a unison ring mounting arrangement comprising:

means on said unison ring defining an end face in a plane generally perpendicular to said main axis, means on said unison ring defining an overhanging flange at a radially outer extremity of said end face extending beyond the plane thereof, means on said unison ring defining a notch in said end face having a planar bottom surface parallel to the plane of said end face, means on said unison ring defining a bolt hole therein intersecting and perpendicular to said bottom surface of said notch, a strut including a bearing surface at a radially inboard end thereof and a planar mounting tab at a radially outboard end thereof having a ring side and a washer side and a clearance slot therein, means on said strut defining a platform thereon on said washer side of said mounting tab, said mounting tab being disposed in said notch with said ring side thereof abutting said bottom surface of said notch and such that said bearing surface on said strut adjoins a bearing surface on said compressor case and said platform is generally parallel to said overhanging flange and said clearance slot registers with said bolt hole, an eccentric flat washer having a clearance hole therein and a cam edge therearound, said eccentric flat washer abutting said washer side of said mounting tab between said platform on said strut and said overhanging flange on said unison ring with said clearance hole therein registering with said unison ring bolt hole and with said cam edge engaging each of said platform and said overhanging flange so that the distance between said platform and said overhanging flange is varied when said eccentric flat washer is rotated, and bolt means extending into said bolt hole and through said clearance slot in said mounting tab and said clearance hole in said eccentric flat washer and operative to clamp said eccentric flat washer against said mounting tab and said mounting tab against said unison ring so that the relative position of said strut is captured and said eccentric flat washer reacts loads between said platform and said overhanging flange.

3. In a gas turbine engine having a stage of variable geometry compressor vanes on a generally cylindrical compressor case of said engine centered on a main axis of said engine and a unison ring around said compressor case for setting the angle of attack of each compressor vane in said stage, a unison ring mounting arrangement comprising:

means on said unison ring defining an end face in a plane generally perpendicular to said main axis, means on said unison ring defining an overhanging flange at a radially outer extremity of said end face extending beyond the plane thereof, means on said unison ring defining a notch in said end face having a planar bottom surface parallel to the plane of said end face, means on said unison ring defining a bolt hole extending through said unison ring and perpendicular to and intersecting said bottom surface of said notch, a strut including a bearing surface at a radially inboard end thereof and a planar mounting tab at a radially outboard end thereof having a ring side and a washer side and a clearance slot therein, means on said strut defining a platform thereon on said washer side of said mounting tab, said mounting tab being disposed in said notch with said ring side thereof abutting said bottom surface of said notch and such that said bearing surface on said strut adjoins a bearing surface on said compressor case and said platform is generally parallel to said overhanging flange and with said clearance slot registers with said bolt hole, a bolt having a threaded body portion and a bolt head at one end, means on said bolt at said one end thereof defining an integral eccentric flat washer portion having a cam edge therearound, said body portion of said bolt extending through said bolt hole in said unison ring and said clearance slot in said mounting tab with said integral flat washer portion abutting said washer side of said mounting tab between said platform on said strut and said overhanging flange on said unison ring and with said cam edge engaging each of said platform and said overhanging flange so that the distance between said platform and said overhanging flange is varied when said bolt is rotated, and a nut threaded onto said bolt body portion on the opposite side of said unison ring from said bolt head operative when tightened against said opposite side to clamp said eccentric washer portion against said mounting tab and said mounting tab against said unison ring so that the relative position of said strut is captured and said eccentric washer portion reacts loads between said platform and said overhanging flange.

* * * * *